US007137371B2

(12) United States Patent
Simpson et al.

(10) Patent No.: US 7,137,371 B2
(45) Date of Patent: Nov. 21, 2006

(54) PHASER WITH A SINGLE RECIRCULATION CHECK VALVE AND INLET VALVE

(75) Inventors: Roger T. Simpson, Ithaca, NY (US); Marty Gardner, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 267 days.

(21) Appl. No.: 10/765,794

(22) Filed: Jan. 27, 2004

(65) Prior Publication Data

US 2004/0182344 A1 Sep. 23, 2004

Related U.S. Application Data

(60) Provisional application No. 60/445,748, filed on Feb. 7, 2003.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 5,002,023 | A | 3/1991 | Butterfield et al. | 123/90.15 |
| 5,046,460 | A | 9/1991 | Butterfield et al. | 123/90.15 |
| 5,107,804 | A | 4/1992 | Becker et al. | 123/90.17 |
| 5,657,725 | A * | 8/1997 | Butterfield et al. | 123/90.17 |
| 6,453,859 | B1 | 9/2002 | Smith et al. | 123/90.17 |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A variable cam timing phaser for an internal combustion engine having at least one camshaft comprising a housing, a rotor, a spool valve, and a recirculation check valve. The housing and the rotor define at least one vane which separate chambers, advanced and retard. The spool valve comprises a spool having a plurality of lands mounted within a bore in the rotor. The spool is slidable from an advance position through a holding position to a retard position. The phaser also has an advance exhaust passage, a retard exhaust passage, and a return passage to route operating fluid to the chambers. The recirculation check valve is in the return passage and only allows flow of fluid from the advance chamber into the return passage when the spool is in the retard position and fluid from the retard chamber into the return passage when the spool is in the advance position.

4 Claims, 9 Drawing Sheets

PHASER WITH A SINGLE RECIRCULATION CHECK VALVE AND INLET VALVE

REFERENCE TO RELATED APPLICATIONS

This application claims an invention which was disclosed in Provisional Application No. 60/445,748, filed Feb. 7, 2003, entitled "CAM TORQUE ACTUATED PHASER WITH A SINGLE RECIRCULATION CHECK VALVE AND INLET VALVE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing systems. More particularly, the invention pertains to a cam torque actuated phaser having a single recirculation valve.

2. Description of Related Art

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

SUMMARY OF THE INVENTION

A variable cam timing phaser for an internal combustion engine having at least one camshaft comprising a housing, a rotor, a spool valve, and a recirculation check valve. The housing and the rotor define at least one vane which separate chambers, advanced and retard. The spool valve comprises a spool having a plurality of lands mounted within a bore in the rotor. The spool is slidable from an advance position through a holding position to a retard position. The phaser also has an advance exhaust passage, a retard exhaust passage, and a return passage to route operating fluid to the chambers. The recirculation check valve is in the return passage and only allows flow of fluid from the advance chamber into the return passage when the spool is in the retard position and fluid from the retard chamber into the return passage when the spool is in the advance position.

DETAILED DESCRIPTION OF THE INVENTION

An internal combustion engine has a crankshaft driven by the connecting rods of the pistons, and one or more camshafts, which actuate the intake and exhaust valves on the cylinders. The timing gear on the camshaft is connected to the crankshaft with a timing drive, such as a belt, chain or gears. Although only one camshaft is shown in the figures, it will be understood that the camshaft may be the only camshaft of a single camshaft engine, either of the overhead camshaft type or the in-block camshaft type, or one of two (the intake valve operating camshaft or the exhaust valve operating camshaft) of a dual camshaft engine, or one of four camshafts in a "V" type overhead cam engine, two for each bank of cylinders.

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

Figure 1:
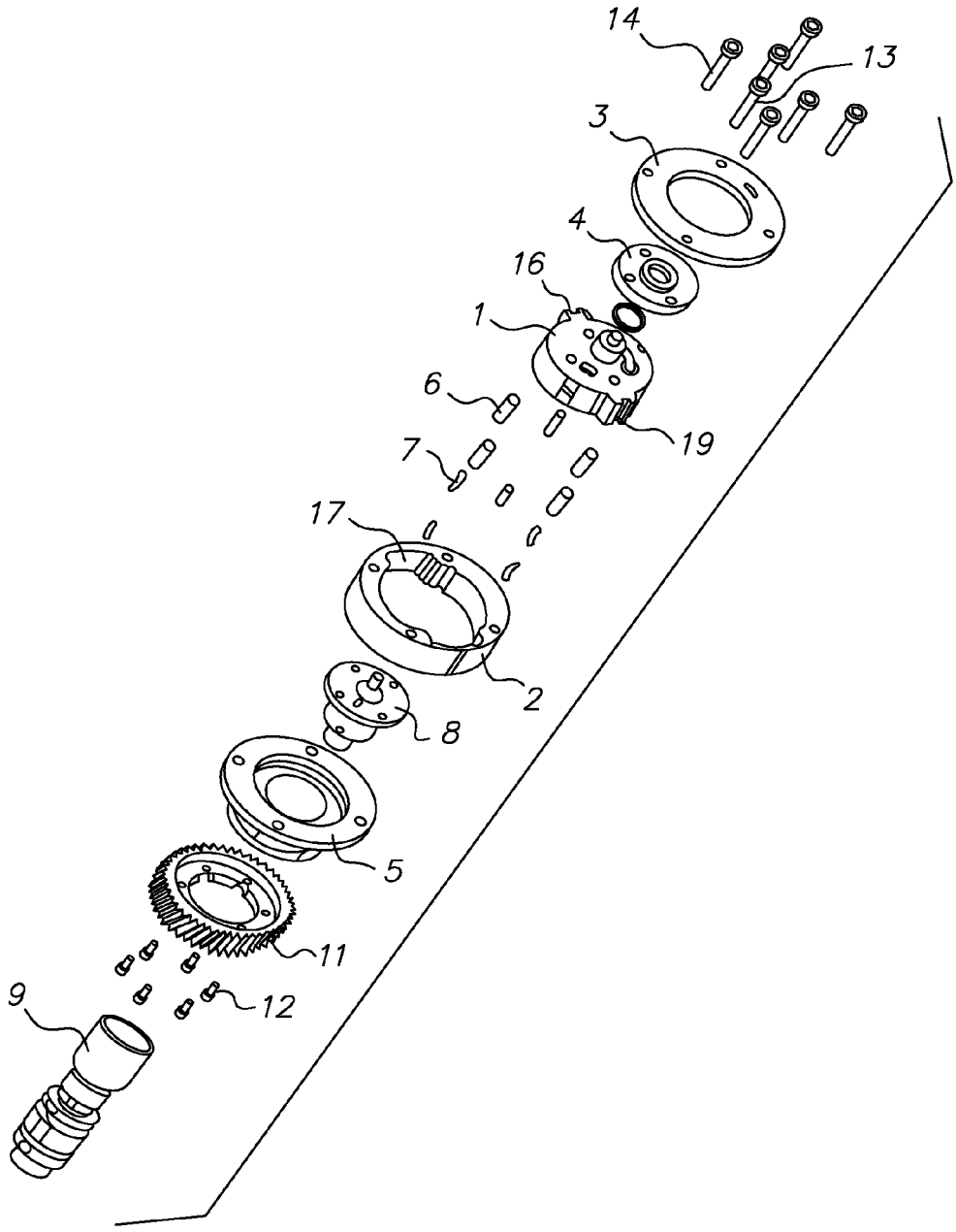
FIG. 1 shows an exploded side view of the camshaft in an embodiment of the present invention.

Referring to FIG. 1, a rotor (1) is fixedly positioned on the camshaft (9), by means of mounting flange (8), to which it (and rotor front plate (4)) is fastened by screws (14). The rotor (1) has a diametrically opposed pair of radially outwardly projecting vanes (16), which fit into recesses (17) in the housing body (2). The inner plate (5), housing body (2), and outer plate (3) are fastened together around the mounting flange (8), rotor (1) and rotor front plate (4) by screws (13), so that the recesses (17) holding the vanes (16), enclosed by outer plate (3) and inner plate (5), form fluid-tight chambers. The timing gear (11) is connected to the inner plate (5) by screws (12). Collectively, the inner plate (5), housing body (2), outer plate (3) and timing gear (11) will be referred to herein as the "housing". The vanes (16) of the rotor (1) fit in the radially outwardly projecting recesses (17), of the housing body (2), the circumferential extent of each of the recesses (17) being somewhat greater than the circumferential extent of the vane (16) which is received in such recess to permit limited oscillating movement of the housing relative to the rotor (1). The vanes (16) are provided with vane tips (6) in receiving slots (19), which are biased outward by linear expanders (7). The vane tips (6) keep engine oil from leaking between the inside of the recesses (17) and the vanes (16), so that each recess is divided into opposed chambers (17*a*) and (17*b*) shown in FIGS. 3–8. Each of the chambers (17*a*) and (17*b*) of the housing (2) is capable of sustaining hydraulic pressure. Thus, application of pressure to chambers (17*a*) will move the rotor clockwise relative to the rotor (1), and application of pressure to chambers (17*b*) will move the rotor counter-clockwise relative to the rotor (1) as shown in the figures.

Figure 2:
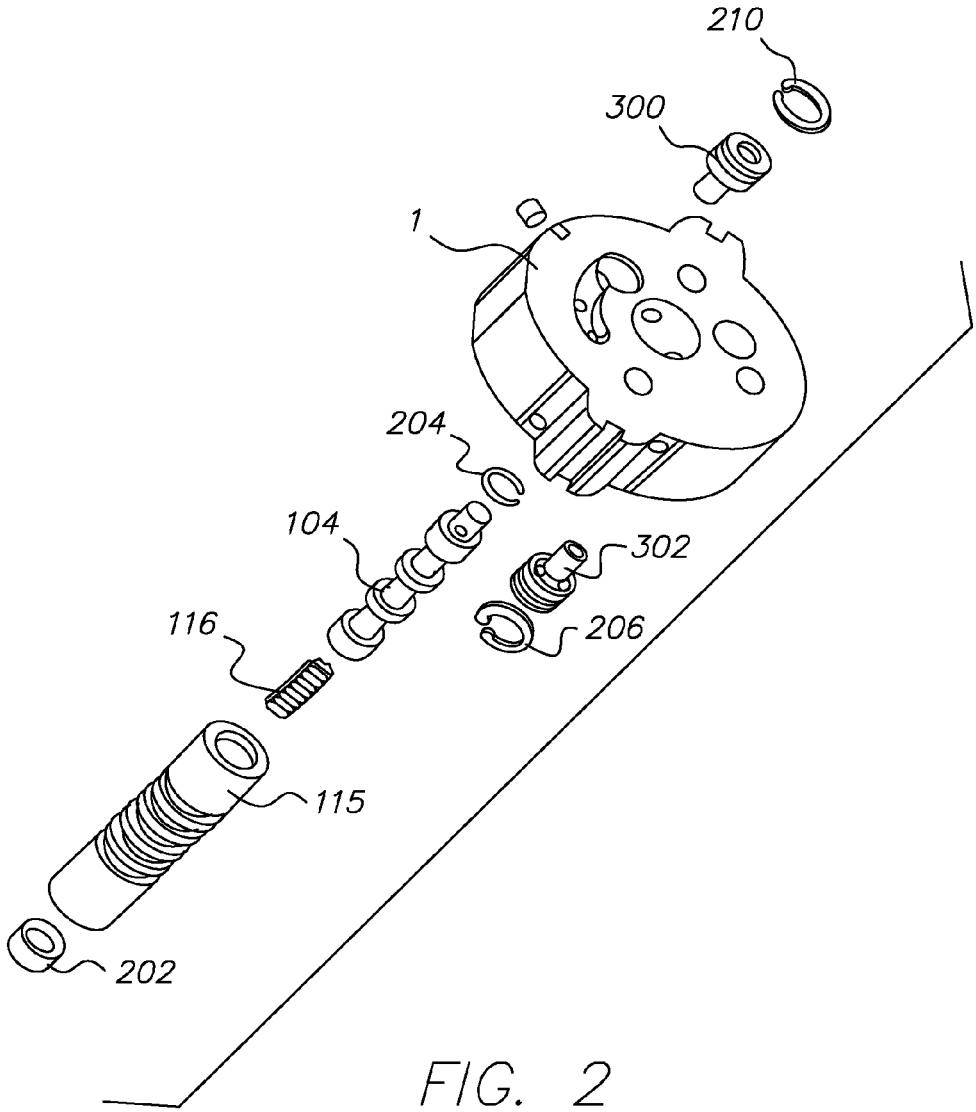
FIG. 2 shows an exploded side view of the rotor in an embodiment of the present invention.

FIG. 2 shows a side view of the rotor (1), which houses the spool valve (109). Spool valve (109) includes a spool (104) and a cylindrical member (115). A retaining ring (204) fits at one end of the spool (104). A plug (202) is pressed flush with the cylindrical member (15) surface. The spring (116) abuts the plug (202). Inlet check valve (300) and recirculation check valve (302) within the rotor (1) include retaining rings (210) and (206) respectively.

Figure 3:
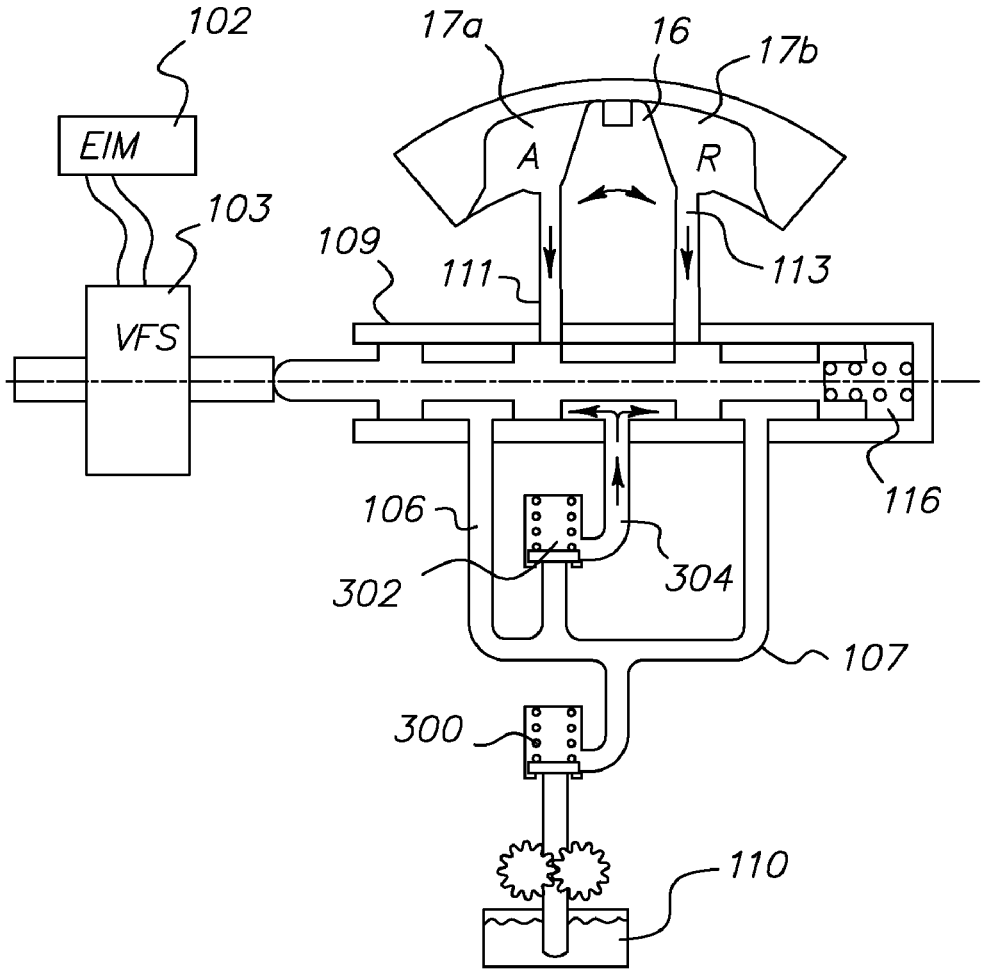
FIG. 3 shows a schematic of the cam torque actuated phaser of the present invention in the null position.

FIG. 3 shows a schematic of cam torque actuated phaser in the null position. The phaser operating fluid of hydraulic fluid (122), illustratively in the form of engine lubricating oil flows into chambers (17*a*) (labeled "A" for "advance") and (17*b*) (labeled "R" for "retard") is introduced into the phaser by way of a common inlet line (110). Within the inlet line (110) is an inlet check valve (300) that is used only to supply make up oil to the phaser. The inlet line (110) leads to three lines, advance exhaust port (106), return line (304), and retard exhaust port (107). The return line (304) contains a recirculation check valve (302), which is used for both advancing and retarding the phaser. The position of the spool valve (109) dictates which chamber (17*a*) or (17*b*) is exhausting and which chamber is filled through the recirculation check valve (302). The spool (104) is slidable back and forth and includes lands (104*a*), (104*b*), and (104*c*) which fit snugly within cylindrical member (115). The spool lands (104*a*), (104*b*), and (104*c*) are preferably cylindrical lands. To maintain a phase angle, the spool (104) is positioned at null, as shown in FIG. 3. While the phaser is in null position, spool lands (104*b*) and (104*c*) overlap and block inlet lines (111) and (113), preventing hydraulic fluid other than the smallest amount of makeup oil into or out of the chamber (17*a*), (17*b*).

Since the phaser is cam torque actuated (CTA) there is always going to be leakage present. Make up hydraulic fluid or oil is supplied to the common inlet line (110). The common inlet line (110) contains an inlet check valve (300). The inlet check valve is only open when there is neither resistive nor driving torque, namely during null position. With the placement of the check valve in the common inlet line, as shown in FIGS. 3 though 9, it eliminates the problem with the oil in the chambers leaking out when the engine is shut off.

Figure 4A:
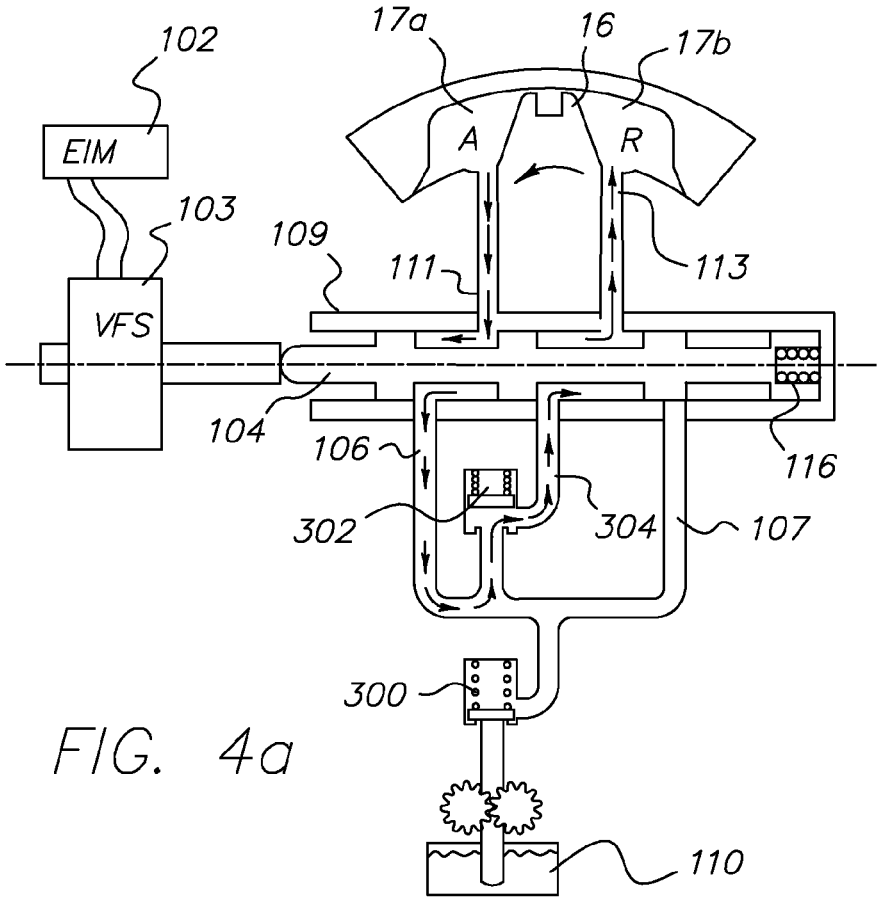
FIG. 4*a* shows a schematic of the cam torque actuated phaser of the present invention in the retard position with the camshaft opening the valve.
Figure 4B:
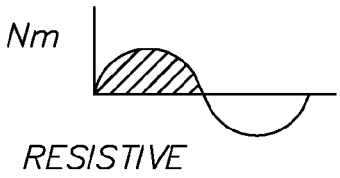
FIG. 4*b* shows a graph of the cam torsional energy.
Figure 4C:
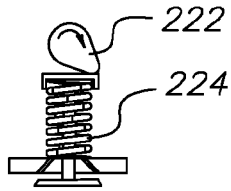
FIG. 4*c* shows the position of the cam lobe.

FIG. 4*a* shows a schematic of the cam torque actuated phaser in the retard position, specifically when the phase shift allows the valve to open. The spool (104) is moved inward (to the right in the figures) to shift the phaser to the retard position by the force actuator (103) which is controlled by an electronic control unit (ECU) (102). The shift of the spool (104) compresses spring (116). As the spool is shifted to the right, the camshaft lobe (222) compresses the valve spring (224), see FIGS. 4*b* and 4*c*, and resistive torque, having a positive value is created. The resistive torque causes the rotor (1) attached to the camshaft (9) to lag behind the chain-driven sprocket housing (not shown). When the cam lobe (222) is compressing the valve spring (224), the advance chamber (17*a*) contains high pressure, forcing the hydraulic fluid (122) out of the advance chamber (17*a*) and into inlet line (111). From inlet line (111) the hydraulic fluid (122) exhausts out the advance exhaust port (106) and into return line (304) containing recirculation check valve (302). From here the hydraulic fluid enters the inlet line (113) leading to the retard chamber (17*b*), moving the vane (16) in the direction indicated in the figure.

Figure 5A:
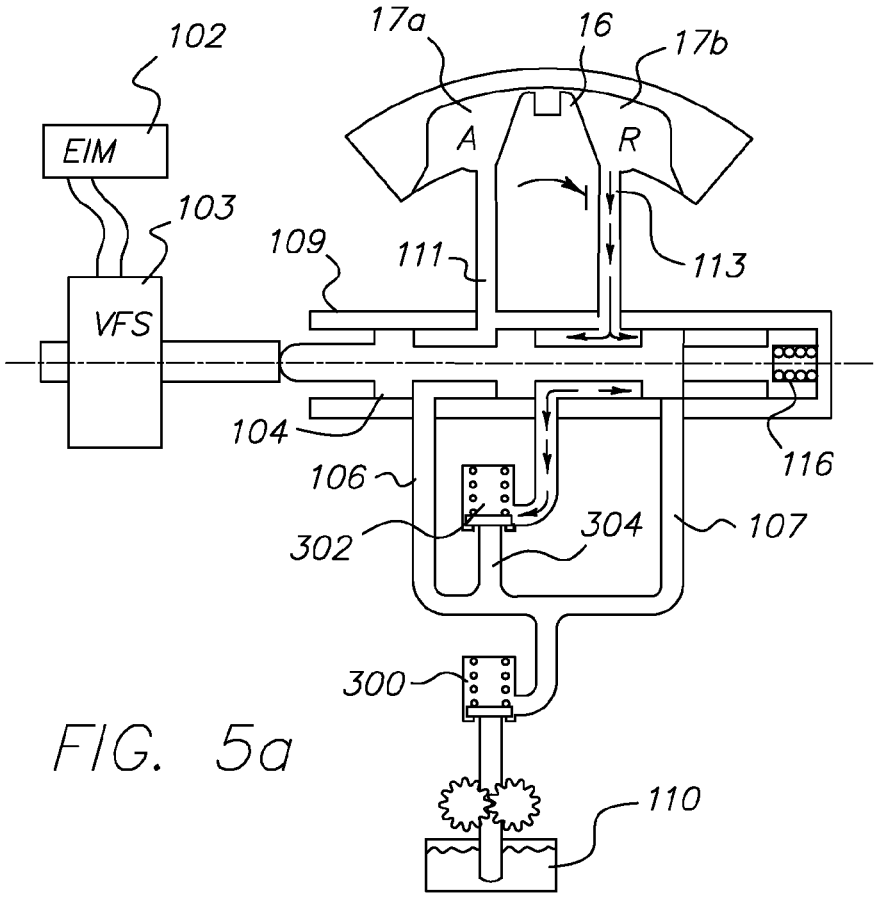
FIG. 5*a* shows a schematic of the cam torque actuated phaser of the present invention in the retard position with the camshaft closing the valve.
Figure 5B:
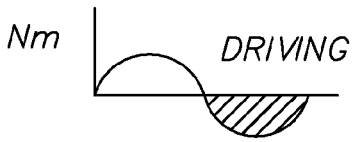
FIG. 5*b* shows a graph of the cam torstional energy.
Figure 5C:
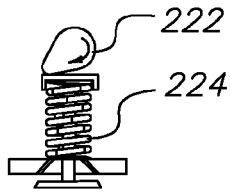
FIG. 5*c* shows the position of the cam lobe.

FIG. 5*a* shows a schematic of the cam torque actuated phaser in the retard position, specifically when the phase shift allows the valve to close. As shown in FIG. 5*c*, the cam lobe (222) is moving past its center and the valve spring (224) is trying to drive the camshaft (9) and the rotor (1). This driving force, see FIG. 5*b*, tries to push hydraulic fluid (122) back out of the retard chamber (17*b*) and into chamber (17*a*). However, recirculation check valve (302) is closed and the hydraulic fluid (122) has to recirculate back to the retard chamber (17*b*). Therefore, when the spool (104) is moved inward, hydraulic fluid (122) may only flow from the advance chamber (17*a*) to the retard chamber (17*b*) and not reverse. The flow from the retard chamber (17*b*) to the advance chamber (17*a*) is prevented by the recirculation check valve (302).

Figure 6A:
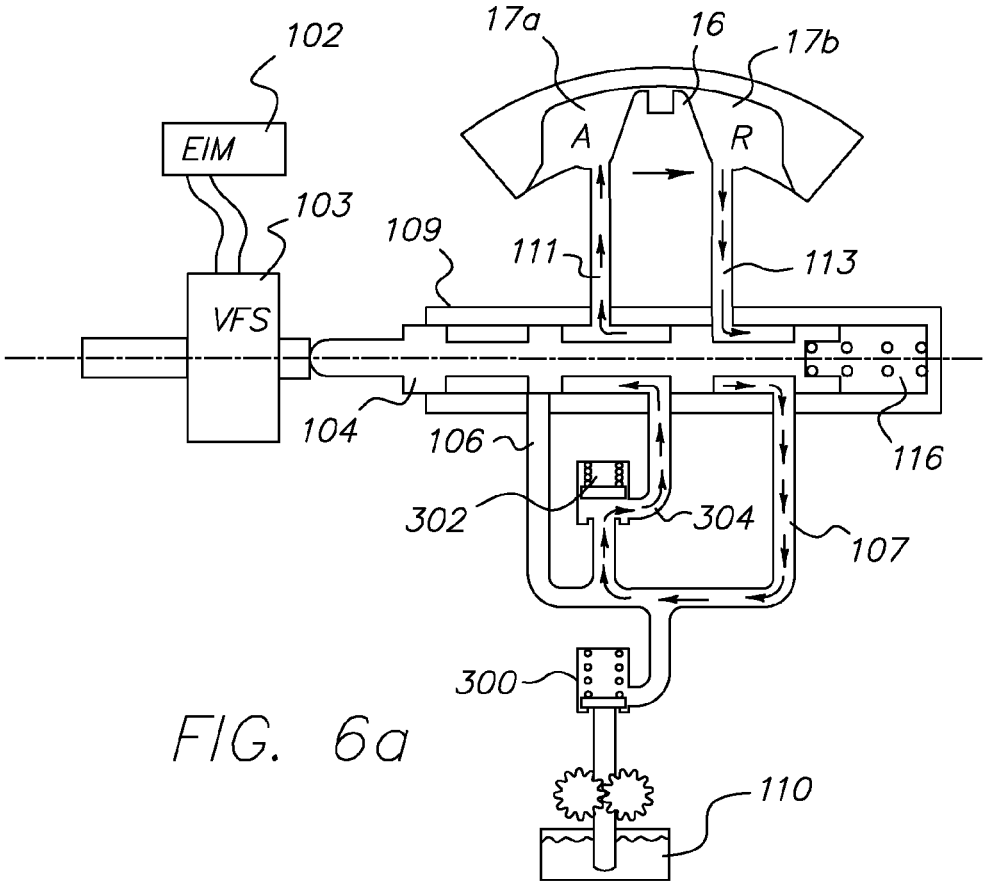
FIG. 6*a* shows a schematic of the cam torque actuated phaser of the present invention in the advance position with the camshaft closing the valve.
Figure 6B:
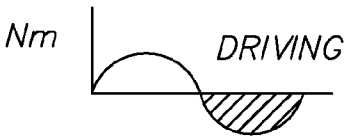
FIG. 6*b* shows a graph of the cam torstional energy.
Figure 6C:
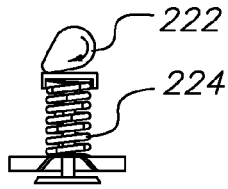
FIG. 6*c* shows the position of the cam lobe.

FIG. 6*a* shows a schematic of the cam torque actuated phaser in the advance position, specifically when the phase shift allows the valve to close. The spool (104) is moved outward (to the left in the figures) to shift the phaser to the advance position by force actuator (103). As shown in FIG. 6*c*, the cam lobe (222) has moved past its center and the valve spring (224) is pushing on the cam lobe (222) to try and accelerate or drive the camshaft. FIG. 6*b* shows the driving torque as a negative torque. The driving torque causes the rotor, attached to the camshaft to increase in velocity, so that is rotating faster than the chain-driven sprocket housing. When the valve spring (224) is pushing on the cam lobe (222) the retard chamber (17*b*) contains high pressure, forcing the hydraulic fluid (122) out of the retard chamber (17*b*) and into inlet line (113). From inlet line (113), the hydraulic fluid exhausts out of the retard exhaust port (107) and into return line (304) containing recirculation check valve (302). From here hydraulic fluid enters the inlet line (111) leading to the advance chamber (17*a*), moving the vane (16) in the direction indicated in the figure. Thus, the hydraulic fluid (122) that is in the retard chamber (17*b*) is moved to the advance chamber (17*a*) when a driving torque, a negative torque, is present.

Figure 7A:
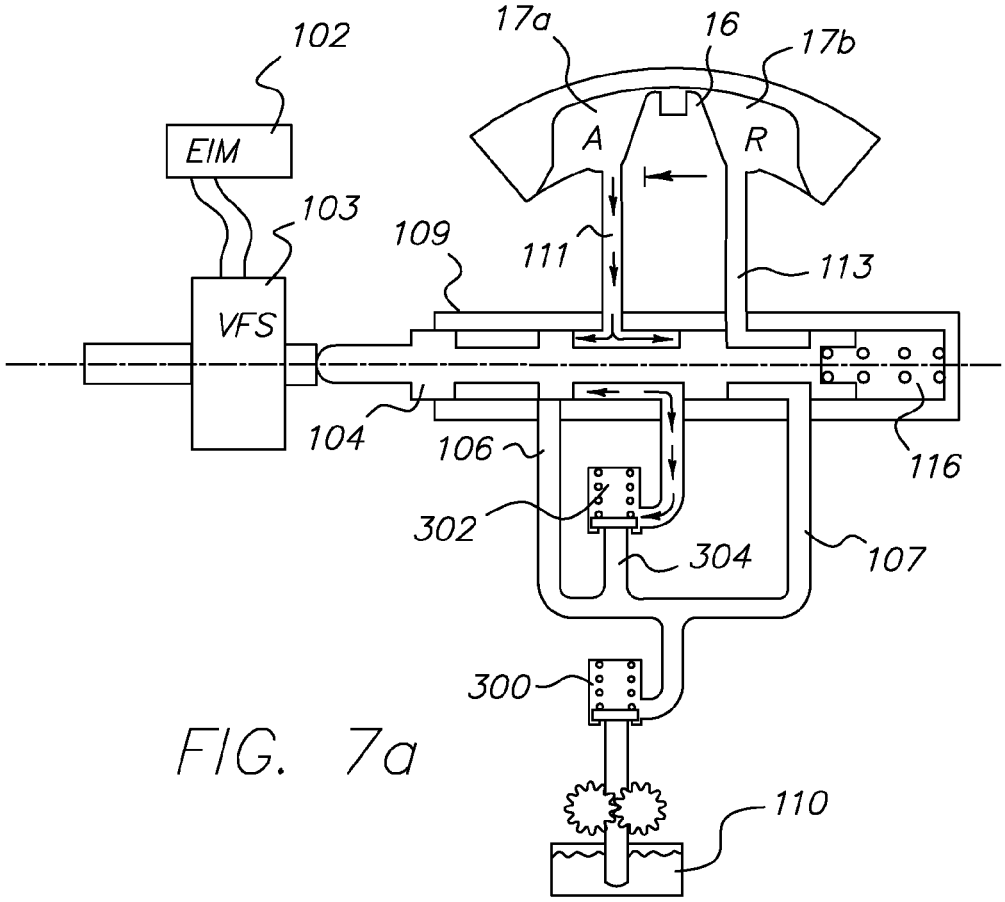
FIG. 7*a* shows a schematic of the cam torque actuated phaser of the present invention in the advance position with the camshaft opening the valve.
Figure 7B:
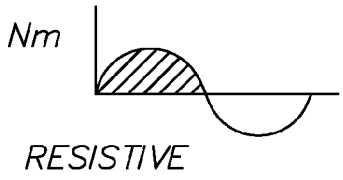
FIG. 7*b* shows a graph of the cam torstional energy.
Figure 7C:
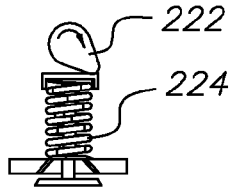
FIG. 7*c* shows the position of the cam lobe.

FIG. 7*a* shows a schematic of the cam torque actuated phaser in the advance position, specifically when the cam begins a new rotation to open the valve as shown in FIG. 7*c*. When the cam lobe begins the new rotation, the cam lobe wants to lag or slow down. This resistive force having a positive value, as seen in FIG. 7*b*, tries to push the hydraulic fluid (122) out of the advance chamber (17*a*) and into the retard chamber (17*b*). However, recirculation check valve (302) is closed and the hydraulic fluid has to recirculate back to the advance chamber (17*a*). The recirculation of the hydraulic fluid prevents the rotor from losing the movement that was gained when a driving torque was present. Therefore, when the spool (104) is moved outward the hydraulic fluid may only flow from the retard chamber (17*b*) to the advance chamber (17*a*) and not reverse. The flow from the advance chamber (17*a*to the retard chamber (17*b*) is prevented by the recirculation check valve (302).

Figure 8:
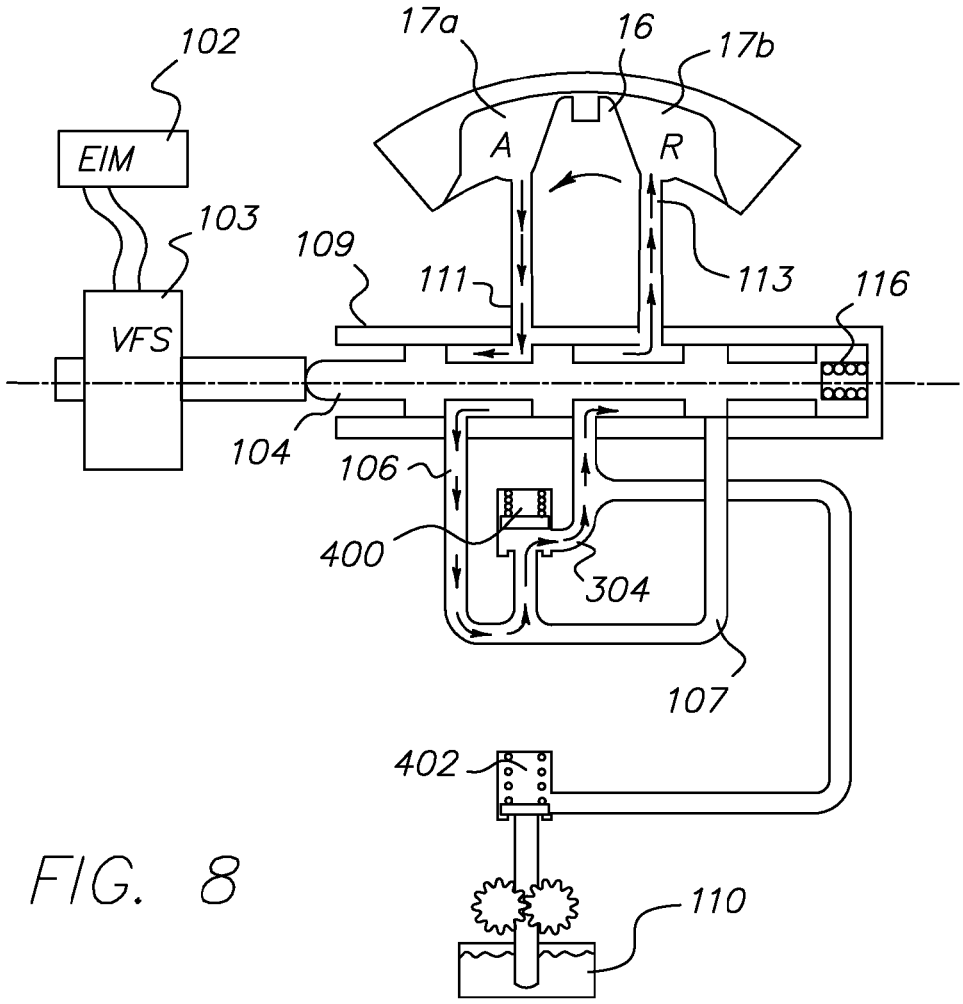
FIG. 8 shows a schematic of an alternative embodiment of the present invention.

FIG. 8 shows an alternative embodiment where an outlet of the inlet check valve (402) is between the recirculation check valve (400) and the return line (304). This formation may be used when the supply pressure is usually low. By placing the inlet check valve (402) as indicated in FIG. 8, there is a pressure drop across the recirculation valve of the amount of the recirculation valve's cracking pressure.

Figure 9:
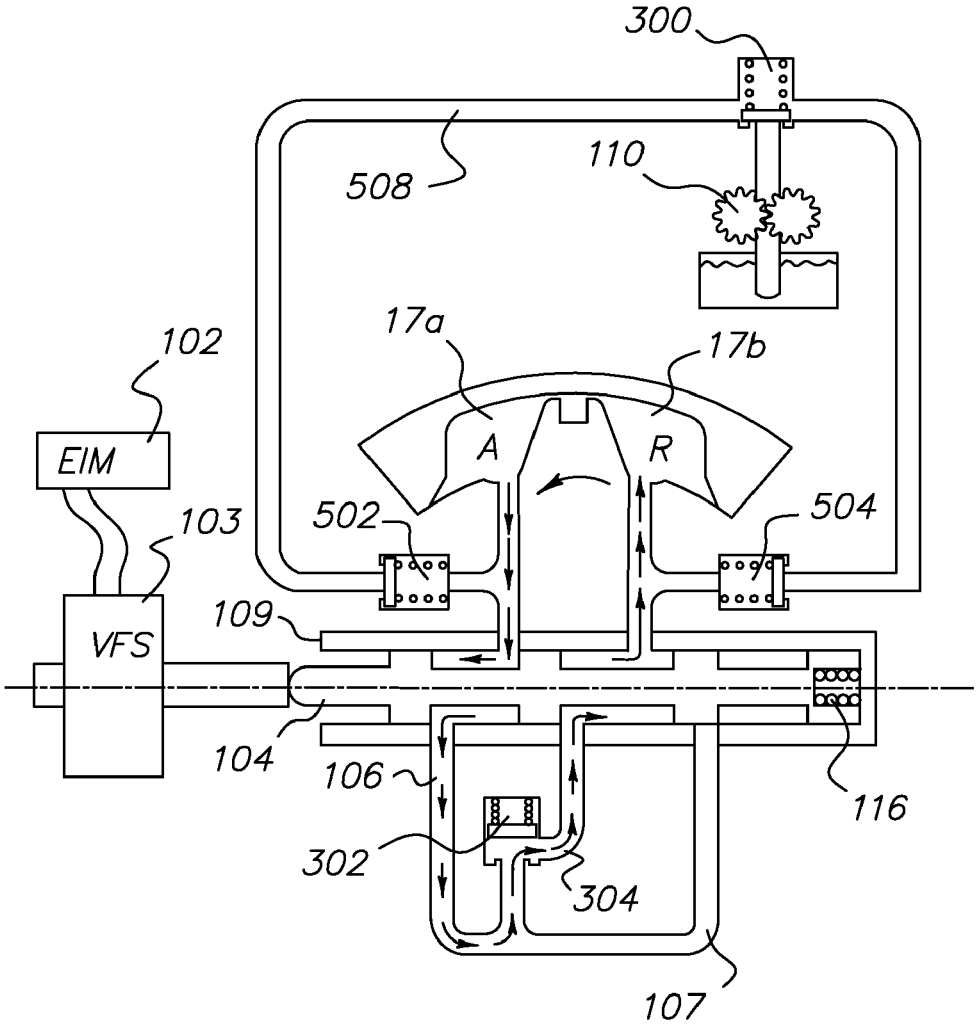
FIG. 9 shows another schematic of a second alternative embodiment of the present invention.

FIG. 9 shows another alternative embodiment in which two inlet check valves (502) and (504) are connected to each other via line (508) and are located between the advance chamber (17*a*) and the retard chamber (17*b*) and the spool (104). By placing additional inlet check valves (502), (504) as indicated by the figure, the advance chamber (17*a*) and retard chamber (17*b*) are always full when the spool valve is at the null position. This is espically important when there is a large overlap and a close clearance spool valve. If the two inlet check valves were not present, an additional movement or dither would be necessary to open the inlet lines (111), (113) to the advance (17*a*) and retard chambers (17*b*).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine having at least one camshaft comprising:

a housing having an outer circumference for accepting drive force;

a rotor for connection to a camshaft coaxially located within the housing, the housing and the rotor defining at least one vane separating a plurality of chambers, at least one chamber being an advance chamber and another chamber being a retard chamber, the vane being capable of rotation to shift the relative angular position of the housing and the rotor;

a spool valve comprising a spool having a plurality of lands slidably mounted within a bore in the rotor, the spool slidable from an advance position through a holding position to a retard position;

an advance passage extending from the advance chamber to the spool valve;

a retard passage extending from the retard chamber to the spool valve;

an advance exhaust passage extending from the spool valve to a return passage, for routing fluid back to the advance chamber and the retard chamber through the spool valve;

a retard exhaust passage extending from the spool valve to the return passage for routing fluid back to the advance chamber and the retard chamber through the spool valve;

a single recirculation check valve in the return passage allowing fluid to flow in a first direction and preventing fluid flow in an opposite direction;

a supply passage coupled to the return passage for supplying operating fluid to the advance chamber and the retard chamber through the single recirculation check valve for makeup only;

wherein the single recirculation check valve in the return passage is between the supply passage and the spool valve;

wherein when the spool is in the retard position, fluid flows from the advance chamber through the advance passage, the spool and the advance exhaust passage and into the return passage through the single recirculation check valve to the retard chamber;

wherein when the spool is in the advance position fluid flows from the retard chamber through the retard passage, the spool and the retard exhaust passage and into the return passage through the single recirculation check valve to the advance chamber.

2. The phaser of claim 1, further comprising a check valve in the supply passage.

3. A variable cam timing phaser for an internal combustion engine having at least one camshaft comprising:

a housing having an outer circumference for accepting drive force;

a rotor for connection to a camshaft coaxially located within the housing, the housing and the rotor defining at least one vane separating a plurality of chambers, at least one chamber being an advance chamber and another chamber being a retard chamber, the vane being capable of rotation to shift the relative angular position of the housing and the rotor;

a spool valve comprising a spool having a plurality of lands slidably mounted within a bore in the rotor, the spool slidable from an advance position through a holding position to a retard position;

an advance passage extending from the advance chamber to the spool valve;

a retard passage extending from the retard chamber to the spool valve;

an advance exhaust passage extending from the spool valve to a return passage, for routing fluid back to the advance chamber and the retard chamber through the spool valve;

a retard exhaust passage extending from the spool valve to the return passage for routing fluid back to the advance chamber and the retard chamber through the spool valve;

a connecting passage extending from the advance passage to the retard passage coupled to supply, the connecting passage having a first inlet check valve between the supply and the advance passage and a second inlet check valve between the supply and the retard passage;

a single recirculation check valve in the return passage allowing fluid to flow in a first direction and preventing fluid flow in an opposite direction;

wherein the single recirculation check valve in the return passage is between the supply passage and the spool valve;

wherein when the spool is in the retard position, fluid flows from the advance chamber through the advance exhaust passage and into the return passage through the single recirculation check valve to the retard chamber;

wherein when the spool is in the advance position fluid flows from the retard chamber through the retard exhaust passage and into the return passage through the single recirculation check valve to the advance chamber; and wherein when the spool is in the holding position, fluid flows from the supply, through the connecting passage and the first inlet check valve to the advance chamber and through the second inlet check valve to the retard chamber for makeup only.

4. The phaser of claim 3, further comprising a supply inlet check valve between the supply and the connecting passage.

* * * * *